US005355970A

United States Patent [19]

Hade, Jr. et al.

[11] Patent Number: 5,355,970

[45] Date of Patent: Oct. 18, 1994

[54] MUTLICELL ARTICULATED RISER SYSTEM FOR A SELF PROPELLED AERIAL WORK PLATFORM

[75] Inventors: Donald C. Hade, Jr., Waynesboro; Robert D. Backer, Rouzerville, both of Pa.

[73] Assignee: Kidde Industries, Inc., Iselin, N.J.

[21] Appl. No.: 111,933

[22] Filed: Aug. 26, 1993

[51] Int. Cl.[5] ..... B66F 11/04

[52] U.S. Cl. ..... 182/2; 182/63

[58] Field of Search ..... 182/2, 63; 212/261; 52/117, 118; 248/281.1

[56] References Cited

U.S. PATENT DOCUMENTS 3,253,677 5/1966 Krynytzky et al. ..... 182/2
4,059,170 11/1977 Young ..... 182/2 X
4,616,798 10/1986 Smeenge et al. ..... 248/281.1
4,757,875 7/1988 Hade, Jr. et al. ..... 182/2
5,088,676 2/1992 Orchard et al. ..... 248/281.1 X
5,226,776 7/1993 Jestergaard ..... 182/2 X
5,249,643 10/1993 Backer et al. ..... 52/118 X

*Primary Examiner*—Alvin C. Chin-Shue
*Attorney, Agent, or Firm*—Brady, O'Boyle & Gates

[57] ABSTRACT

An articulated riser system for aerial access equipment wherein a parallelogram linkage is provided by a support frame, a riser frame assembly, and a pair of substantially parallel arms pivotally connected at each end to the support frame and riser frame assembly. The parallel arms are positioned one above the other and the lower arm is provided with a multicell cross-sectional configuration larger than the tubular cross-sectional configuration of the upper arm so that heavier loads can be supported by aerial access equipment than if both parallel arms had the same cross-sectional configuration. A trough is provided in the upper surface of the lower arm so that the upper arm is nested therein when the parallelogram linkage is in its fully lowered and fully raised positions.

13 Claims, 4 Drawing Sheets

MUTLICELL ARTICULATED RISER SYSTEM FOR A SELF PROPELLED AERIAL WORK PLATFORM

BACKGROUND OF THE INVENTION

In U.S. Pat. No. 4,757,875, dated Jul. 19, 1988, owned by the same assignee as the instant application, a self propelled aerial work platform is disclosed wherein a pair of substantially parallel tubular arms are each pivotally connected at one end to the superstructure support frame, and at the opposite end to the riser frame assembly to which the telescopic boom assembly, having a work platform mounted on its outermost end, it pivotally connected.

The parallel tubular arms are typically rectangular in cross-section, having the same dimensions and spaced one above the other. While this parallelogram linkage has been satisfactory for its intended purpose, it has been found that heavier loads can be supported by the boom assembly if the lower arm, which is the tension member in the parallelogram linkage, is fabricated to have a larger cross-sectional configuration than the upper arm, which is the compression member in the parallelogram linkage. It has been further found that the compactness of the riser assembly is not sacrificed in using a larger lower arm by constructing the lower arm in such a manner that the upper arm of the parallelogram linkage nests within the lower arm in its fully lowered and fully raised positions.

SUMMARY OF THE INVENTION

The articulated riser system of the present invention comprises, essentially, a pair of substantially parallel arms pivotally connected at one end to the superstructure support frame and at the opposite end to the riser frame assembly. The lower arm of the parallelogram linkage is constructed and arranged to have a larger cross-sectional configuration than the upper arm. The lower arm is provided with a plurality of closed cells, and has a trough provided in the upper surface thereof for receiving the upper tubular arm of rectangular cross-sectional configuration, whereby the upper arm is nested within the lower arm in its fully lowered and fully raised positions, and the lower arm has closed cell structures extending on three sides of the upper arm.

DESCRIPTION OF THE PREFERRED EMBODIMENT

Figure 1:
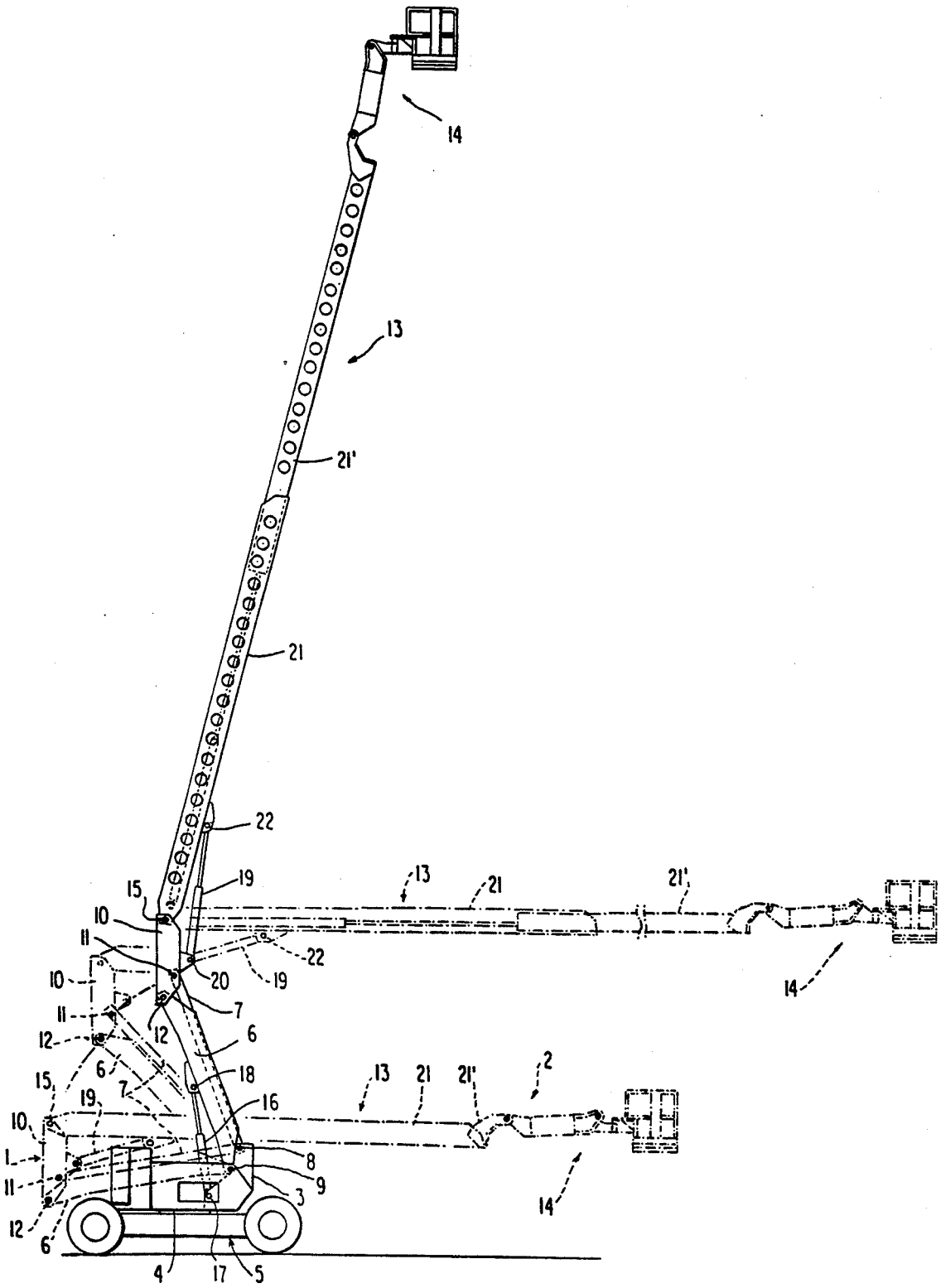
FIG. 1 is an elevational view of a self propelled aerial work platform provided with the articulated riser system of the present invention, showing the relative positions of the upper and lower arms of the parallel linkage during the various working positions of the work platform.
Figure 2:
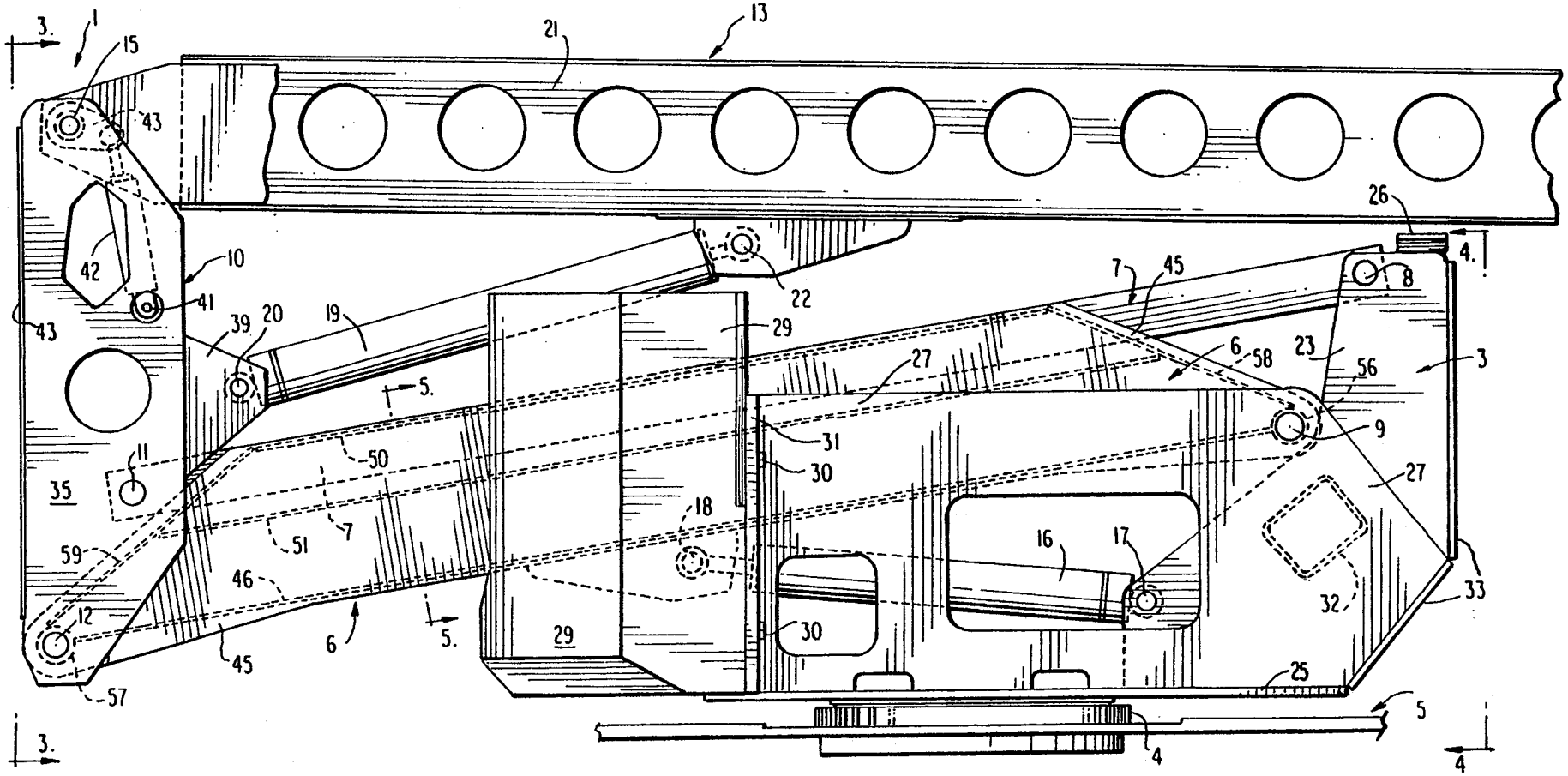
FIG. 2 is an enlarged, fragmentary, side elevational view of the articulated riser system of the present invention in its lower-most position.

Referring to the drawings, and more particularly to FIGS. 1 and 2, the multicell articulated riser system 1 of the present invention is adapted to be used on a self propelled aerial work platform 2 of the type disclosed in U.S. Pat. No. 4,757,875, wherein a superstructure support frame 3 is mounted on a turntable 4 carried by a vehicle chassis 5.

The riser system comprises a pair of substantially parallel upper and lower arms 6 and 7; each of which are pivotally connected at one end to the support frame 3 as at 8 and 9, and at the respective opposite end to a riser frame assembly 10, as at 11 and 12. A hydraulically extendable and retractable telescopic boom assembly 13, having a base section 21 and fly section 21', and having a work platform 14 articulately mounted on the outermost end of the fly section 21', is pivotally connected to the riser frame assembly as at 15. A lower hydraulic lift cylinder 16 is pivotally connected between the support frame 3 and the arm 6 as at 17 and 18, respectively, whereby the arms 6 and 7 and riser frame assembly 10, as well as telescopic boom assembly 13 carried by the riser frame assembly 10, may be raised and lowered with respect to the vehicle. A boom lift cylinder 19 is similarly pivotally connected between the riser frame assembly 10, as at 20, and the base section 21 of the telescopic boom assembly 13, as at 22, whereby the telescopic boom assembly 13 can be raised and lowered with respect to the riser frame assembly 10, as shown in FIG. 1.

Figure 4:
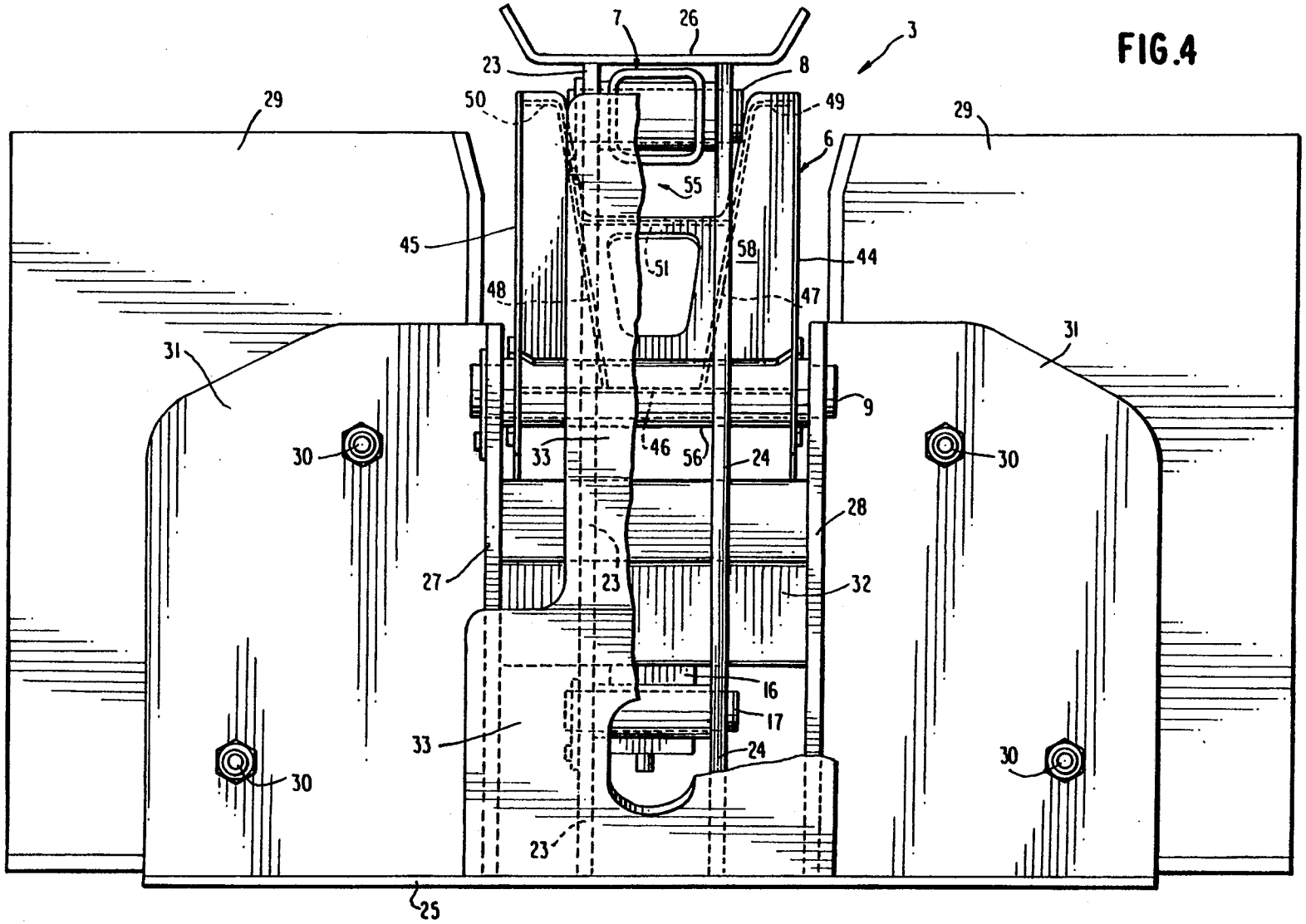
FIG. 4 is an end elevational view, partly broken away, taken substantially along line 4—4 of FIG. 2.

The details of the construction of the support frame 3 are illustrated in FIGS. 2 and 4, wherein it will be seen that a pair of spaced, parallel vertically extending plates 23 and 24 are integral with a bottom wall 25 mounted on the turntable 4. A cradle 26 is fixed to the upper end of the plates 23 and 24 for supporting the base section 20 of the telescopic boom assembly 13 when the boom has been moved to the stored position.

The plates 23 and 24 also support the pivot 8 for the upper arm 7, and the pivot 17 for the lower left cylinder 16. A pair of vertical side walls 27 and 28, spaced laterally outwardly from the plates 23 and 24 are integral with the bottom wall 25 and provide a support for the pivot 9 of lower arm 6, and a counterweight assembly having a pair of counterweight portions 29 bolted as at 30 to end walls 31 integral with the side walls 27 and 28.

To complete the basic structure of the support frame 3, a transversely extending tubular reenforcing member 32 extends through the plates 23 and 24 and is integrally connected thereto and is connected at its opposite ends to the walls 27 and 28, and an end wall 33 extends across the plates 23 and 24 and the lower end portions of walls 27 and 28. Other reinforcing plates, not shown, may be connected between plates 23 and 24, and between plates 23 and 27, and between plates 24 and 28, opposite to and spaced from end wall 33, and adjacent pivots 17 and 9, respective.

Figure 3:
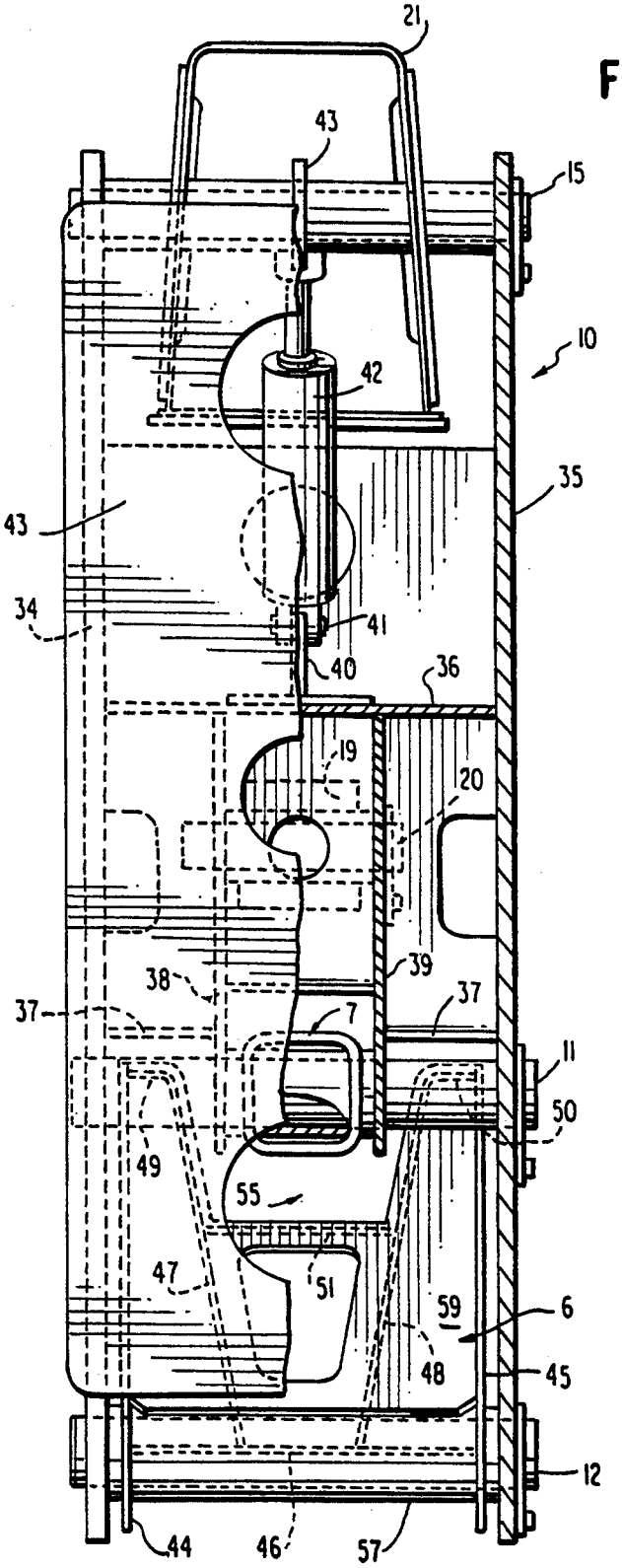
FIG. 3 is an end elevational view, partly broken away in vertical section, taken substantially along line 3—3 of FIG. 2.

The details of the construction of the riser frame assembly 10 are illustrated in FIGS. 2 and 3, wherein it will be seen that a pair of side walls 34 and 35 are integrally connected by transverse walls 36 and 37. The side walls 34 and 35 support the telescopic boom assembly pivot 15 at the upper end thereof, and adjacent the lower ends support the pivot 11 for the upper arm 7 and the pivot 12 for the lower arm 6. Another pair of spaced walls 38 and 39 are positioned inwardly of the side walls 34 and 35, and are integral with the transverse walls 36 and 37, and provide a bracket for supporting the pivot 20 of the telescopic boom assembly lift cylinder 19. The top surface of the transverse wall 36 supports a bracket 40 (FIG. 3) to which one end 41 of a master cylinder 42 (FIG. 2) is pivotally connected, the opposite end of the master cylinder 42 being pivotally connected to the inner end of the telescopic boom assembly base section 21 as at 43. As is understood by those skilled in the art, the master cylinder 42 is in fluid communication with a slave cylinder (not shown) mounted on the outer end of fly section 21' of the telescopic boom 13 and is connected to the work platform assembly 14 (FIG. 1), whereby the work platform is maintained in a horizontal position during the luffing of the telescopic boom assembly 13 by lift cylinder 19.

To complete the riser frame assembly 10, an end wall 43 is integral with the ends of the side walls 34 and 35.

Figure 5:
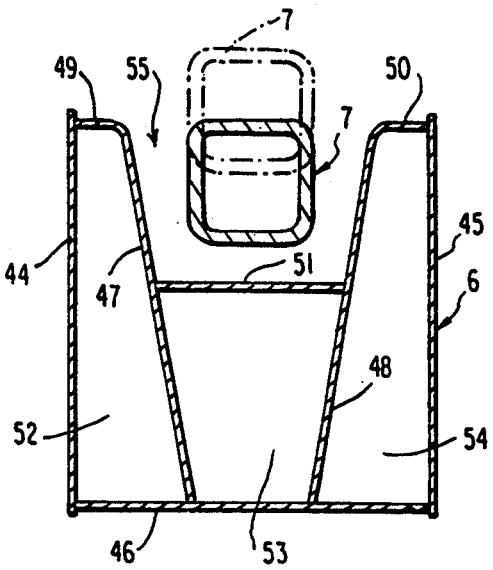
FIG. 5 is a cross-sectional view taken along line 5—5 of FIG. 2, and showing in phantom the position of the upper arm in the medial raised position of the parallel linkage.

FIG. 5 illustrates the cross-sectional configuration of the lower arm 6 and the upper arm 7. The lower arm 6 comprises a pair of spaced vertical side walls 44 and 45 integral with a bottom wall 46. A pair of upwardly divergent walls 47 and 48 are positioned between and spaced from the side walls 44 and 45. The lower ends of the divergent walls 47 and 48 are integral with the bottom wall 46 and the upper end portions of the divergent walls are bent outwardly as at 49 and 50 and integrally connected to the side walls 44 and 45, respectively. A transverse plate 51 extends between a medial portion of the divergent walls 47 and 48 and is integrally connected thereto, to thereby form the arm 6 having a plurality of cells 52, 53 and 54 . The transverse plate 51 and upper end portions of the divergent walls 47 and 48 define a trough 55 for receiving the upper tubular arm 7 which can be any cross-sectional shape, such as rectangular in cross-section, as shown. The opposite ends of the lower arm 6 have journals 56 and 57, for the pivot connections 9 and 12, respectively, the journals being connected to and extending between the vertical side walls 44 and 45, and connected to the opposite ends of bottom wall 46. The opposite ends of arm 6 are preferably formed on a bias and closed with upwardly converging end walls 58 and 59 integrally connected between the side walls 44 and 45, and at the lower edges to the journals 56 and 57, respectively, as well as to the ends of transverse plate 51 and the upper end portions of the divergent walls 47 and 48. The upper ends of end walls 58 and 59 are provided with notches in alignment with the trough 55.

In operation, when the lift cylinder 16 is first actuated to pivot the parallelogram linkage provided by the support frame 3, the lower and upper arms 6 and 7, and the riser frame assembly 10, from its lower-most stowed position (FIG. 2), to lift the boom assembly 13 to a higher elevation, the upper arm 7 is fully nested within the trough 55 of the lower arm 6 as shown in FIGS. 1 and 2. Continued extension of the lift cylinder 16 will cause the riser frame assembly 10 to raise, while remaining vertically disposed, to pivot about connections 12 and 11 causing the upper arm 7 to move slightly out of the nested position within the trough 55 of lower arm 6, as shown the intermediate position in FIG. 1, and the phantom line position in FIG. 5. Continued extension of the lift cylinder 16 to position the parallelogram linkage 3, 6, 7 and 10 to support the boom assembly 13 and associated work platform assembly 14 in the uppermost, raised, working position will result in the upper arm 7 becoming nested once again within the trough 55 of the lower arm 6, as shown in FIG. 1.

From the above description it will be readily appreciated by those skilled in the art that the multi-cell arrangement of the lower arm 6 provides a substantially larger cross-sectional configuration than the upper arm 7, whereby heavier loads can be supported by the boom assembly and parallelogram linkage, than have been possible with prior art parallelogram linkage structures. By providing the trough 55 in the upper surface of the lower arm 6 for receiving the upper tubular arm 7, the compactness of the riser assembly is not sacrificed by using a larger lower arm. This structure thus enables the construction of aerial work platforms having greater working heights, and or having greater load lifting capacities, while maintaining stability in the riser assembly and not disproportionately increasing the space required by the parallelogram arms for a machine of a given size.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. An articulated riser system for aerial access equipment comprising, a support frame, a riser frame assembly, a pair of substantially parallel arms comprising an upper arm positioned above a lower arm, one end of each arm being pivotally connected to said support frame, the opposite end of each arm being pivotally connected to the riser frame assembly, a load supporting boom assembly pivotally connected to said riser frame assembly, a lift cylinder being operatively connected between the support frame and the lower arm, the riser frame assembly, support frame and parallel arms providing a parallelogram linkage for lifting the boom assembly from a stored position to an operating position, the cross-sectional configuration of said lower arm being larger than the cross-sectional configuration of said lower arm comprising a pair of spaced vertical side walls integral with a bottom wall, a pair of divergent walls positioned between and spaced from said side walls, said divergent walls being integrally connected to and extending upwardly from said bottom wall, the upper end portions of each of said divergent walls extending outwardly and integrally connected to a respective said side wall, a transverse plate positioned above said bottom wall and extending between and integrally connected to said pair of divergent walls, whereby said lower arm is provided with a plurality of cells defined by the interconnection of said bottom wall, side walls, divergent walls and transverse plate.

2. An articulated riser system according to claim 1, wherein a trough is provided in the upper surface of said lower arm, said trough being defined by said transverse plate, and the upper end portions of said pair of divergent walls, whereby said upper arm is nested within the trough when the parallelogram linkage is in its fully lowered and fully raised position, whereby the compactness of the parallelogram linkage is not sacrificed by employing a lower arm having a larger cross-sectional configuration than the upper arm.

3. An articulated riser system according to claim 2, wherein said upper arm is tubular in cross-sectional configuration.

4. An articulated riser system according to claim 2, wherein said upper arm is rectangular in cross-sectional configuration.

5. An articulated riser system according to claim 2, said lower arm including journals at opposite ends connected between said side walls for the pivot connections to said support frame and said riser frame assembly, and end walls at opposite ends of said lower arm connected between said side walls and converging upwardly from said journals to the upper end portions of said divergent walls.

6. An articulated riser system according to claim 5, including notches in the upper end portions of said end walls in alignment with said trough.

7. An articulated riser system for aerial access equipment comprising, a support frame, a riser frame assembly, a pair of substantially parallel arms comprising an upper arm positioned above a lower arm, one end of each arm being pivotally connected to said support frame, the opposite end of each arm being pivotally connected to the riser frame assembly, a load supporting boom assembly pivotally connected to said riser frame assembly, a lift cylinder being operatively connected between the support frame and the lower arm, the riser frame assembly, support frame and parallel arms providing a parallelogram linkage for lifting the boom assembly from a stored position to an operating position, the cross-sectional configuration of said upper arm, said lower arm having an upper surface portion, spaced side walls, and a bottom wall, all integrally connected, a trough having a bottom portion in said upper surface portion, said bottom portion spaced from said bottom wall, and said cross-sectional configuration of said lower arm including plural interconnected structural cells extending longitudinally and interior of said lower arm and defining said trough, one structural cell positioned on each side of said trough, and another structural cell positioned beneath said trough, and said upper arm nested in and movable in said trough during movement of said parallelogram linkages from its lowered stowed position to its fully raised position.

8. An articulated riser system according to claim 7, wherein said cross-sectional configuration of said lower arm is positioned on three sides of the cross-sectional configuration of said upper arm.

9. An articulated riser system for aerial access equipment comprising, a support frame, a riser frame assembly, a pair of substantially parallel arms comprising an upper arm positioned above a lower arm, one end of each arm being pivotally connected to said support frame, the opposite end of each arm being pivotally connected to the riser frame assembly, a load supporting boom assembly pivotally connected to said riser frame assembly, a lift cylinder being operatively connected between the support frame and the lower arm, the riser frame assembly, support frame and parallel arms providing a parallelogram linkage for lifting the boom assembly from a stored position to an operating position, the cross-sectional configuration of said lower arm being larger than the cross-sectional configuration of said upper arm and being positioned on three sides of the cross-sectional configuration of said upper arm, said lower arm comprises a pair of spaced side walls integral with a bottom wall, a pair of upwardly divergent walls connected to said bottom wall between and spaced from said side walls, said divergent walls having upper end portions connected to upper end portions of said side walls, a transverse plate connected between a medial portion of said divergent walls, and said transverse plate and the upper portions of said pair of divergent walls defining a trough in said lower arm in which said upper arm is nested.

10. An articulated riser system for aerial access equipment comprising, a support frame, a riser frame assembly, a pair of substantially parallel arms comprising an upper arm positioned above a lower arm, one end of each arm being pivotally connected to said support frame, the opposite end of each arm being pivotally connected to the riser frame assembly, a load supporting boom assembly pivotally connected to said riser frame assembly, a lift cylinder being operatively connected between the support frame and the lower arm, the riser frame assembly, support frame and parallel arms providing a parallelogram linkage for lifting the boom assembly from a stored position to an operating position, the cross-sectional configuration of said lower arm being larger than the cross-sectional configuration of said upper arm, said lower arm having an upper surface portion, the cross-sectional configuration of said lower arm comprising a pair of spaced side walls integral with a bottom wall, a pair of upwardly divergent walls positioned between and spaced from said side walls, said divergent walls having upper end portions integrally connected to a respective said side wall, a transverse plate spaced above said bottom wall and extending between and integrally connected to said pair of divergent walls, and said transverse plate and pair of upwardly divergent walls defining a trough in said upper surface portion of said lower arm in which said upper arm is nested during movement of the parallelogram linkage.

11. An articulated riser system according to claim 10, said lower arm including journals connected at opposite ends for the pivot connections to said support frame and said riser frame assembly, and opposite end walls extending upwardly from said journals to said upper surface portion.

12. An articulated riser system according to claim 11, including notches in the upper end portions of said opposite end walls in alignment with said trough.

13. An articulated riser system according to claim 12, in which said notches have a bottom edge and upwardly divergent side edges respectively in registration with said transverse plate and pair of upwardly divergent walls.

* * * * *